US009003568B2

(12) United States Patent
Hofmeister et al.

(10) Patent No.: US 9,003,568 B2
(45) Date of Patent: Apr. 14, 2015

(54) DISPOSABLE GLOVE

(75) Inventors: Klaus-Dieter Hofmeister, Lengerich (DE); Andre Huneke, Lengerich (DE)

(73) Assignee: Bischof + Klein GmbH & Co. KG, Lengerich (DE)

( * ) Notice: Subject to any disclaimer, the term of this patent is extended or adjusted under 35 U.S.C. 154(b) by 0 days.

(21) Appl. No.: 13/704,245

(22) PCT Filed: May 28, 2011

(86) PCT No.: PCT/EP2011/002647

§ 371 (c)(1), (2), (4) Date: Dec. 14, 2012

(87) PCT Pub. No.: WO2011/157353

PCT Pub. Date: Dec. 22, 2011

(65) Prior Publication Data

US 2013/0086732 A1 Apr. 11, 2013

(30) Foreign Application Priority Data

Jun. 16, 2010 (DE) ..... 20 2010 009 124 U

(51) Int. Cl.
*A41D 19/00* (2006.01)

(52) U.S. Cl.
CPC ..... *A41D 19/0006* (2013.01); *A41D 19/0068* (2013.01); *A41D 2400/52* (2013.01); *A41D 2500/30* (2013.01); *A41D 2500/52* (2013.01)

(58) Field of Classification Search
CPC ..... A42D 19/015
USPC ..... 2/161.6
See application file for complete search history.

(56) References Cited

U.S. PATENT DOCUMENTS

| | | | | |
|---|---|---|---|---|
| 4,643,791 | A | 2/1987 | Jurrius et al. | |
| 5,774,889 | A * | 7/1998 | Gochanour | 2/16 |
| 6,360,373 | B1 * | 3/2002 | Rehn et al. | 2/161.6 |
| 6,637,035 | B1 | 10/2003 | Brinkmann et al. | |
| 2004/0245268 | A1 * | 12/2004 | Grinberg | 221/34 |
| 2005/0066413 | A1 * | 3/2005 | Mattesky | 2/161.6 |
| 2005/0204451 | A1 | 9/2005 | Plut et al. | |
| 2011/0083249 | A1 | 4/2011 | Wochner | |

FOREIGN PATENT DOCUMENTS

| | | | |
|---|---|---|---|
| AU | 2005 100 702 | A4 | 10/2005 |
| DE | 298 11 160 | U1 | 9/1998 |
| DE | 200 04 858 | U1 | 8/2000 |

(Continued)

OTHER PUBLICATIONS

TASCO, DuPont Tyvek Nonwoven Fiber Lab COats, TASCO, Mar. 2014.*

*Primary Examiner* — Amber Anderson
(74) *Attorney, Agent, or Firm* — Gudrun E. Huckett

(57) ABSTRACT

The invention relates to a disposable glove (1) made of two layers (2, 4) of thin planar water-tight plastic material, which are connected to each other by a sealing seam (5) along a hand contour so as to leave open a slip-on opening (3), wherein said glove is produced in a form that is favorable, comfortable to handle, and small to pack and that can be contoured correctly to one's hand and that can be produced simply, even in large scale production, in such a way that at least one of the layers (2, 4) is made of a fine-pore, non-woven polyethylene fiber material that is pressed on both sides with heat and pressure to form fiber laminate surfaces and that has a weight per unit area of less than 100 g/m$^2$.

5 Claims, 1 Drawing Sheet

(56) References Cited

FOREIGN PATENT DOCUMENTS

| | | | |
|---|---|---|---|
| EP | 2 308 330 | A1 | 4/2011 |
| JP | 100 181 14 | A | 1/1998 |
| JP | 2004 044028 | A | 2/2004 |
| JP | 2008081895 | A | 4/2008 |
| WO | 98/55299 | A1 | 12/1998 |

* cited by examiner

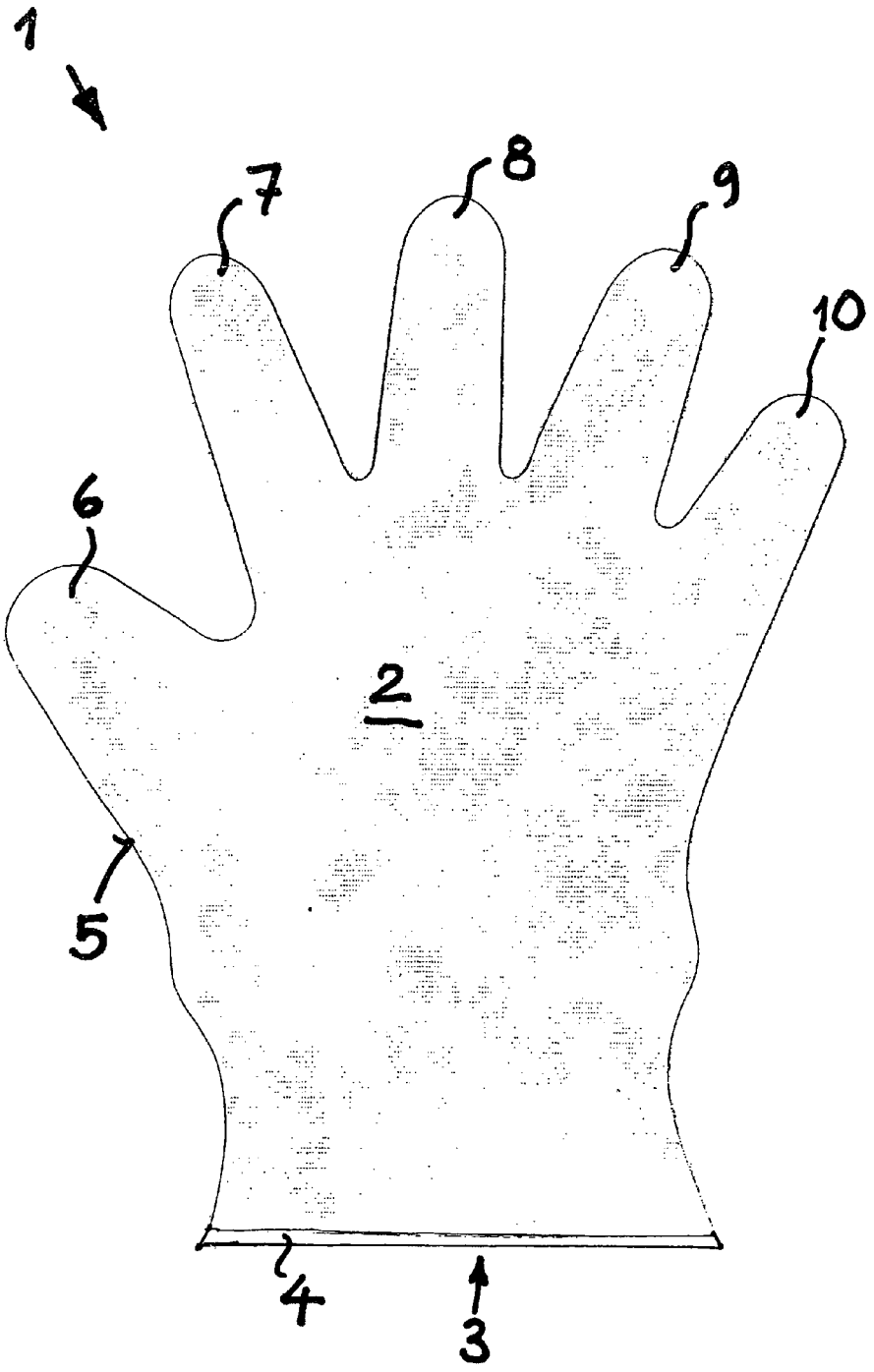
1
7
8
9
10
6
2
5
4
3

DISPOSABLE GLOVE

BACKGROUND OF THE INVENTION

The invention concerns a disposable glove of two layers of thin flat water-tight plastic material that are connected to each other by a sealing seam along a hand contour leaving open a slip-on opening. Disposable gloves of simple and very inexpensive plastic material films are customary for many every day applications, for example, for kitchen work or bicycle repair for protecting the hands or in foodstuff sales for hygienic aspects or in clean room technology with regard to cleanness aspects. The water-tight and dirt-tight film material, which is employed in a form as thin as possible not only for weight and cost considerations but also because of higher flexibility, constitutes however a vapor barrier, causing skin moisture and vapor from the skin to deposit on the inner side and leading to an uncomfortable wet feeling or even to droplet formation that must be prevented in hygienic or clean room applications.

Known are also disposable gloves produced with greater expenditure that are lined on the inner side with an absorbing (liner) material in order to absorb moisture collecting on the inner side of the tight film glove (DE 298 11 160 U1, JP 10018114A, JP 2008081895A). Such multi-layer glove designs limit of course the sensitivity and thus the usability in case of technical tasks, e.g. in clean room applications. However, such a design primarily makes the glove more expensive based on material and manufacturing expenditure. Disposable gloves, i.e. gloves that generally are disposed of after single use and are to be replaced based on cleanness and material purity aspects, are subject to rigorous pricing pressure. Moreover, disposable gloves with multilayer configuration, in particular with absorbing liner, are more voluminous and accordingly cannot be packed with small size for the demand-oriented high numbers.

It is therefore the object of the present invention to provide a disposable gloves that is simple and inexpensive when manufacture on a large scale, wherein the glove should be easy to handle, packable to a small size, and have proper hand fit, while the perspiration problems that occur with conventional tight plastic films are avoided.

SUMMARY OF THE INVENTION

According to the invention, this object is solved by a disposable glove wherein at least one of the layers is comprised of a fine-pore nonwoven polyethylene fiber material compressed at both sides with heat and pressure to fiber laminate surfaces with a weight per surface area of less than 100 g/m$^2$. It has been found that for such a disposable glove a specially produced commercially available polyethylene fiber material instead of the conventional smooth and tight polyethylene film can be used without having to accept penetration of the glove from the exterior by moisture, dirt or chemical materials and penetration of the glove from the interior to the exterior by perspiration, skin particles or dirt on the skin. The decisive advantage of this material resides in that it provides a moisture (and dirt) barrier of high reliability but at the same time has fine pores that enable gas and vapor permeability and move vapor from the skin surfaces of the hand as well as provide sufficient venting that prevents formation of perspiration and collection of perspiration within the glove.

Such a material has been developed for various technical applications including those in medical technology, but is known primarily in every day use in connection with large size envelopes. With respect to appearance, thickness and flexibility it is paper-like, but is free of cellulose and comprised of fine polyethylene fibers and in particular of HDPE (high-density polyethylene) that are produced in a "flash spin" manufacturing process with a very fine diameters of, on average, approximately 4 micrometer and is then laid in a random fiber layer with nondirectional fibers to a weight per surface area of less than 100 g/m$^2$.

This random fiber layer is laminated on both sides in a through-feed process at a temperature above the melting point and at an appropriate pressure so that on the two surfaces of the random fiber layers a laminated boundary layer of fine fibers that are crosslinked with each other with fine pores of only approximately 20 micrometers is produced, respectively, and provide a permeation barrier for liquid but enable permeability for gasses including vapor. The two surfaces can be provided in this through-feed action with a textured embossment that improves grip of the surface and also improves additionally the flexibility of the material.

In the context of high flexibility of the material, the lamination of the random fiber layer is limited to the surfaces so that an intermediate layer of freely movable fibers remains. In this way, it is possible to more easily ensure that the permeability of the material for gasses is maintained but the laminated layers on both sides form a double barrier with regard to moisture and dirt.

For use in protective gloves it is important that the long-fiber material has no tendency to fibrillate or produce lint and also does not offer fracture particles at cut edges or sealing or welding seams, i.e., like "massive" polyethylene film does not constitute a source of contamination.

Preferably, the PE fiber material is comprised of stronger HDPE fibers and can be fused well with the same or other polyethylene materials. This means initially that such a layer of nonwoven fiber material can be connected with a second layer of the same material to a uniform disposable glove. Since such fiber material products are however significantly more expensive with respect to manufacturing expenditure than simple films and a glove of this kind is to be viewed usually as sufficiently "breathable" when only one of the two glove layers is produced from the special fiber material, an advantageous combination with respect to price results for such a disposable glove with one layer of the fiber material and one layer of a polyethylene film. The thickness of the film is usually to be selected to be thin but sufficient for the protective purpose of the glove against destruction and penetration. In general, because of greater flexibility, an LDPE material (low-density polyethylene) is provided.

Based on "breathable" gas permeability, basically one can select whether the fiber material or the film is provided for the palm or the back of the hand. When use is provided for the right hand or the left hand (generally, such a glove is designed to be used uniformly for both hands), in practice the change between palm and back of the hand also entails changing of the hand. A disposable glove is usually however designed for a certain hand and is then preferably provided at the palm with the polyethylene film that, as a more robust and smoother surface, constitutes the "working side".

Such a glove obtains its contour in a conventional method by a closed separating and sealing seam that leaves open only a slip-on opening for the hand wherein the contour is designed as needed. In general, at least a thumb contour of the hand is formed in order to configure at least a mitt. A further differentiation of the fingers will separately form in addition to the thumb an index finger and usually all fingers are individually formed. In order to provide from the flat material at the inner side sufficient finger cross-sections, laterally to the fingers and adjacent to the contour of the hand to be received, a rim area of more than 5 mm is to be provided. For this purpose, the individual fingers are to be contoured in a spread apart arrangement.

BRIEF DESCRIPTION OF THE DRAWING

One embodiment of the invention is illustrated in the drawing and will be explained in the following in more detail. The single FIGURE of the drawing represents the flat plan view onto a disposable glove.

PREFERRED EMBODIMENTS

A disposable glove (protective glove), in the drawing referenced by 1, is illustrated in flat position wherein a topside, provided for the back of the hand (of a right hand), or back side (first layer) 2 of the glove is resting flat on a bottom side or palm side (second layer) 4 of the glove that is projecting only in the area of a slip-on opening 3 for the hand of the user. This flat position of the glove corresponds to its manufacture from flat material webs that have been placed on top of each other during manufacture and by a separating and sealing seam 5 have been connected to each other and at the same time separated from the excess flat material.

In principle, it is understood that the two (first and second) layers during manufacture can be plastically shaped already for matching the thickness of the hand, in particular the thickness of the fingers. This is however complex and disadvantageous for storage and shipping of such disposable gloves. The flat configuration and arrangement enables shipping of large stores in a space-saving way in stacked arrangement.

The illustrated glove 1 shows shaped portions for a thumb area 6 and for finger areas 7, 8, 9, and 10 wherein thumb and fingers are contoured in a spread-apart position so that thumb and fingers can be cut wider than the basic contour of the hand in order to have available from the flat arrangement of top side and bottom side sufficient space for the corresponding cross-sections when in use.

The portion of the bottom side 4 that is projecting past the top side 2 and can be seen in the area of the slip-on opening 3 serves only for more comfortably separating the top side and the bottom side from each and gripping them upon slipping in the hand.

A special feature of the glove according to the invention relative to the widespread single-use or disposable gloves that are made from two "massive" films of plastic material resides in the breathable configuration. With the fiber material that (for right-hand use) is provided at the top side (first layer) 2 and its gas permeability with simultaneous tightness against moisture and dirt, that for a collection of perspiration with unpleasant feel of the hand, with wet and thus bad gripping action of the glove relative to the hand and with the risk of perspiration droplets escaping from the glove is advantageous for many applications, a still simple thin-walled glove with important comfort properties and application possibilities is provided.

The commercially available fiber material of the first layer 2 is comprised of very fine HDPE fibers (high-density polyethylene) produced by flash spinning that are laid in a nondirectional (random) fiber layer with a weight per surface area of less than 100 g/m$^2$ and are laminated from the loose laid state by precisely adjusted heat and pressure treatment at the surfaces, i.e., are surficially melted and in this way crosslinked to a mesh system. In this context, mesh openings with a mesh width of approximately 20 micrometers are formed that as "pores" ensure gas permeability but at the same time constitute a liquid barrier.

The present glove is used in clean room applications (clean room areas) in silicon manufacture in which high purity single crystal silicon rods are produced and/or cut to disks (wafers) and/or are processed to semiconductor circuits by doping, contacting etc.

It is however understood that this disposable glove is suitable for use in many areas in which the working area is to be protected from moisture or contamination by the hand or the hand is to be protected from dirt or other undesirable working materials. In particular, higher manufacturing costs in comparison to conventional disposable gloves made of simple film are justified when the glove is not used only for a short period of time for a few manipulations but is to be provided for a longer period of use.

What is claimed is:

1. A disposable glove consisting of:

a first layer and a second layer, wherein the first and second layers consist of thin flat water-tight plastic material;

wherein the first and second layers each are arranged in a flat plane and are resting flat on each other;

wherein the first and second layers are connected to each other by a separating and sealing seam formed along a hand contour of a hand, the hand contour outlining a thumb area and a finger area accommodating the fingers of the hand, wherein the thumb area is spread apart from the finger area;

wherein the separating and sealing seam leaves open a slip-on opening;

wherein, when the first layer forms the back side of the glove and the second layer forms the palm side of the glove, the first layer consists of a fine-pore nonwoven polyethylene fiber material consisting of a random layer of nondirectional HDPE (high density polyethylene) fibers having an average thickness of approximately 4 micrometers and compressed at both sides with heat and pressure to form fiber laminate surfaces;

wherein the first layer has a weight per surface area of less than 100 g/m$^2$; and wherein the second layer consists of an LDPE (low density polyethylene) film consisting of LDPE.

2. The glove according to claim 1, wherein the hand contour has a palm area and a thumb area.

3. The glove according to claim 2, wherein the hand contour has several individualized finger areas forming spread-apart fingers of the glove.

4. The glove according to claim 2, wherein the hand contour relative to a basic contour of a hand to be received in the glove is extended by a rim area of more than 5 mm.

5. The glove according to claim 1, wherein the first and second layers at the slip-on opening have edges that are not congruent to each other.

* * * * *